US005884129A

United States Patent [19]

Ichimura et al.

[11] Patent Number: 5,884,129

[45] Date of Patent: Mar. 16, 1999

[54] ELECTROSTATIC-IMAGE DEVELOPER AND IMAGE FORMING PROCESS

[75] Inventors: Masanori Ichimura; Michio Take; Hidekazu Yaguchi; Masaki Hashimoto; Takashi Imai; Hiroshi Takano; Masahiro Takagi; Akihiro Iizuka; Yuka Ishihara, all of Minami-ashigara, Japan

[73] Assignee: Fuji Xerox Co., Ltd., Tokyo, Japan

[21] Appl. No.: 863,914

[22] Filed: May 27, 1997

[30] Foreign Application Priority Data

May 29, 1996 [JP] Japan ..... 8-134591

[51] Int. Cl.[6] ..... G03G 15/08

[52] U.S. Cl. ..... 399/252; 399/222; 399/223; 430/105; 430/111

[58] Field of Search ..... 399/222, 223, 399/231, 252, 267; 430/105, 106.6, 106, 107, 108, 109, 111, 120, 122; 222/DIG. 1

[56] References Cited

U.S. PATENT DOCUMENTS

| | | | |
|---|---|---|---|
| 4,803,518 | 2/1989 | Haneda et al. | 399/231 |
| 4,828,956 | 5/1989 | Creatura et al. | 222/DIG. 1 X |
| 5,073,468 | 12/1991 | Yamamoto et al. | 430/111 X |
| 5,250,996 | 10/1993 | Sugizaki et al. | 430/109 X |
| 5,306,589 | 4/1994 | Yamamoto et al. | 430/111 |
| 5,565,967 | 10/1996 | Ochiai et al. | 399/267 |
| 5,573,880 | 11/1996 | Mayama et al. | 430/106.6 |
| 5,574,543 | 11/1996 | Sakai et al. | 399/223 X |

*Primary Examiner*—Sandra Brase
*Attorney, Agent, or Firm*—Oliff & Berridge, PLC

[57] ABSTRACT

An electrostatic-image developer which comprises: (i) a toner comprising: (a) toner particles containing carbon black in an amount of from 6 to 8% by weight based on the weight of the toner particles and having a volume-average particle diameter of from 3 to 9 $\mu$m; and (b) an external additive; and (ii) a resin-coated carrier having a volume resistivity of from $10^7$ to $10^{11}$ $\Omega$·cm in an electric field of $10^{3.8}$ V/cm and an average particle diameter of from 30 to 60 $\mu$m. Also disclosed are a process for forming a black image and a process for forming a full-color image each using the electrostatic-image developer.

8 Claims, No Drawings

ELECTROSTATIC-IMAGE DEVELOPER AND IMAGE FORMING PROCESS

FIELD OF THE INVENTION

The present invention relates to an electrostatic-image developer for use in developing an electrostatic latent image. The present invention also relates to an image forming processes using the same.

BACKGROUND OF THE INVENTION

In electrophotography, known processes for converting an electrostatic latent image formed on a photoconductive photoreceptor or the like into a visible image with a toner include, for example, magnetic brush development, cascade development and powder cloud development. Toners for use in these development processes are generally mixtures of a thermoplastic resin and a colorant. The toner image formed on a photoconductive photoreceptor or the like by the above or other development processes is transferred to a support such as paper and fixed thereto by pressing and/or heating. With the recent increasing requirement to provide higher image quality in copies, various improvements have been tried to make in both copiers and developers. In particular, a technique frequently used for improving image quality is to employ a toner having a reduced average particle diameter. The use of a toner having a reduced average particle diameter is an effective means for improving image quality. However, this technique is disadvantageous in that triboelectric charging amount is enhanced, resulting in difficulties in obtaining a desired color density, and that the amount of charges which the toner can have per particle decreases, resulting in blurring. Various limitations are hence imposed on the use thereof.

Employed for improving the developing ability are, e.g., a technique of using a carrier having a reduced diameter so as to have an enlarged chargeable surface area and/or a reduced electrical resistance or a technique for development in which toner particles are flown by means of an AC electric field. These techniques are effective in enabling toners having a high-triboelectric charging amount and a small diameter to have a highly improved developing ability and to satisfactorily ensure a maximum color density in solid parts of from 1.5 to 1.9. With respect to the line density in images having a width of from 150 to 500 $\mu$m, the above described conventional techniques are capable of ensuring a line density of 1.0 or higher to enable line or character images made up of such thin lines to be clearly recognizable.

However, the conventional techniques described above have the following problems. In the reproduction of lines or characters (6 to 8 points) having a line width of 100 $\mu$m, which reproduction is recently required to attain further higher image quality in terms of line density and character image density, the reproduced line or character images have a image density of 1.0 or lower and are hence light and unclear. Even when it is attempted to form black toner particles in two or more layers so as to form a thin line having a high image density, the resulting black toner particles are only formed in almost a single layer. This is because the electrostatic latent images on the photoreceptor which correspond to the thin lines have a smaller charge amount unlike solid parts.

If the content of carbon black as a colorant is increased in order to obtain a high density, use of the resulting black toner for development in an AC electric field poses a problem that blurring is caused by charge injection due to combinations of the black toner containing a large proportion of carbon black and having a low electrical resistance with a carrier having a low electrical resistance, resulting in image defects.

Furthermore, if an electrostatic latent image corresponding to thin lines or small characters (6 to 8 points) having a line width of 100 $\mu$m is formed on a photoreceptor in such a manner that the resulting image has a line width larger than 100 $\mu$m in order to heighten only the image density of these lines and characters, there are problems, for example, that the resulting images are deformed although a heightened image density is obtained. In this method, repeated copying operations result in an increase in the line widths of both the thin lines and the characters.

SUMMARY OF THE INVENTION

As described above, conventional techniques have various problems in obtaining a sufficient image density in images having a line width of 100 $\mu$m. The present invention has been made to solve the above described problems.

Accordingly, an object of the present invention is to provide a black developer which contains a small-diameter black toner, which can reproduce not only a solid image and a line and digital dot image having a line width of from 150 to 500 $\mu$m with a sufficient image density, but also reproduce a thin line, a small character (6 to 8 point) and a digital dot each having a line width of 100 $\mu$m with a sufficient image density without causing blurring.

Another object of the present invention is to provide a process for forming a black-image and a process for forming a full-color image, by using the above described black developer to form an image having excellent image quality.

Other objects and effects of the present invention will become apparent from the following description.

As a result of extensive studies made by the present inventors to solve the above-described problems of conventional techniques, the present invention has been completed.

The above objects of the present invention has been achieved by providing an electrostatic-image developer which comprises:

(i) a toner comprising:

(a) toner particles containing carbon black in an amount of from 6 to 8% by weight based on the weight of the toner particles and having a volume-average particle diameter of from 3 to 9 $\mu$m; and (b) an external additive; and (ii) a resin-coated carrier having a volume resistivity of from $10^7$ to $10^{11}$ $\Omega$·cm in an electric field of $10^{3.8}$ V/cm and an average particle diameter of from 30 to 60 $\mu$m.

In the case where the electrostatic-image developer of the present invention is used for forming a full-color image, the carbon black preferably has an average particle diameter of from 40 to 60 nm. The toner particles have a softening point of preferably from 100° to 120° C., more preferably from 110° to 120° C. The term softening point ($T_m$) means the mean temperature between a melting initiation temperature and a melting termination temperature both determined with a flow tester.

The present invention further provides a process for forming a black image which comprises developing an electrostatic latent image on a latent-image holder with a developer layer formed on a developer retainer disposed so as to face the latent-image holder, wherein the development is carried out by using the electrostatic-image developer as described above.

The present invention furthermore provides a process for forming a full-color image which comprises developing an electrostatic image on a latent-image holder with a developer layer formed on a developer retainer disposed so as to face the latent-image holder, by using a black developer, a yellow developer, a magenta developer and a cyan developer, wherein the black developer is the electrostatic-image developer as described above.

In these processes, the development is preferably carried out using an AC bias as a development bias.

DETAILED DESCRIPTION OF THE INVENTION

The present invention is described in detail below.

The toner particles for use in the present invention comprise a binder resin and a colorant as the main components. Examples of the binder resin include homopolymers and copolymers of: styrene and styrene compounds such as chlorostyrene; monoolefins such as ethylene, propylene, butylene and isobutylene; vinyl esters such as vinyl acetate, vinyl propionate, vinyl benzoate and vinyl butyrate; esters of aliphatic α-methylene monocarboxylic acids such as methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Especially representative binder resins for use in the present invention include polystyrene, styrene/alkyl acrylate copolymers, styrene/alkyl methacrylate copolymers, styrene/acrylonitrile copolymers, styrene/butadiene copolymers, styrene/maleic anhydride copolymers, polyethylene and polypropylene. In addition, examples of the binder resin further include polyurethanes, polyimides, epoxy resins, silicone resins, polyamides, modified rosins and paraffin waxes.

The binder resin for use in the present invention is preferably a polyester resin, which is synthesized from a polyhydric alcohol ingredient and a polycarboxylic acid ingredient. The polyhydric alcohol ingredient comprises di- or higher hydric alcohol as an essential component. Preferred examples of the dihydric alcohol include bisphenol A ethylene oxide adducts and bisphenol A propylene oxide adducts. Specific examples thereof include polyoxypropylene(6)-2,2-bis(4-hydroxyphenyl)propane, polyoxyethylene(2.2)-2,2-bis(4-hydroxyphenyl)propane, polyoxypropylene(2)-2,2-bis(4-hydroxyphenyl)propane, and polyoxypropylene(2.0)-polyoxyethylene(2.0)-2,2-bis(4-hydroxyphenyl)propane. The dihydric alcohol may be used in combination with other dihydric alcohols such as ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexanedimethanol, dipropylene glycol, polyethylene glycol, polypropylene glycol, bisphenol A and hydrogenated bisphenol A. The dihydric alcohol may be used in combination with tri- or higher hydric alcohols such as, e.g., glycerol, sorbitol, 1,4-sorbitan and trimethylolpropane.

Examples of the polycarboxylic acid ingredient include maleic acid, maleic anhydride, fumaric acid, phthalic acid, terephthalic acid, isophthalic acid, malonic acid, succinic acid, glutaric acid, dodecenylsuccinic acid, n-octylsuccinic acid, n-dodecenylsuccinic acid, 1,2,4-benzenetricarboxylic acid, 1,2,4-cyclohexanetricarboxylic acid, 1,2,4-naphthalenetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, trimellitic acid, pyromellitic acid and lower-alkyl esters of these acids.

The carbon black for use in the present invention as the colorant of the toner are those superior in inexpensiveness, electrification characteristics, color fastness, etc. In the case where the toner is used as a black toner for forming a full-color image, the carbon black preferably has an average particle diameter of from 40 to 60 nm. If the average particle diameter thereof is smaller than 40 nm, the resulting toner is undesirable for use as a black toner in full-color image formation because the black color of halftone and solid images formed becomes reddish. In the case where the carbon black has an average particle diameter not smaller than 40 nm, the toner provides an image having a bluish black tone, which is a preferred black tone. However, average particle diameters thereof exceeding 60 nm are undesirable because the coloring power is reduced.

In the present invention, the content of carbon black should be in the range of from 6 to 8% by weight based on the weight of the toner particles, i.e., based the whole toner weight excluding the external additive weight. If the content of the carbon black is lower than 6% by weight, small dot images and thin line images have an insufficient image density. If the content thereof exceeds 8% by weight, this presents a problem that blurring is caused by charge injection to generate image defects when the toner is used in combination with a resin-coated semiconducting carrier (having a volume resistivity of from $10^7$ to $10^{11}$ Ω·cm in an electric field of $10^{3.8}$ V/cm).

The black toner particles comprising the ingredients described above should have a volume-average particle diameter of from 3 to 9 μm. The volume-average particle diameter is preferably from 5 to 8 μm. If the volume-average particle diameter thereof is smaller than 3 μm, the charge amount per toner particle is reduced, resulting in a blurred image. If the volume-average particle diameter thereof exceeds 9 μm, the toner provides an image having impaired graininess and a rough surface.

The toner particles preferably have a softening point of from 100° to 120° C., especially from 110° to 120° C. Softening points thereof lower than 100° C. are undesirable in that the black toner upon melting has a reduced viscosity and penetrates into paper during fixing to cause a decrease in color density. Namely, thin line images having a line width of 100 μm or smaller, which by nature have a small toner deposition amount, suffer a considerable decrease in color density, although solid image areas suffer no significant decrease in color density because of a large toner deposition amount thereon. As a result, the thin lines and characters formed with such a black toner have a low image density. On the other hand, if the softening point of the toner particles exceeds 120° C., the viscosity of the black toner upon melting becomes too high, resulting in providing an image having a low gloss. Such a black image is undesirable in that it causes a difference in gloss with a full-color image of yellow, magenta and cyan, which has a high gloss.

The toner for use in the present invention comprises the toner particles described above and one or more external additives added thereto. Examples of the external additives which can be used herein include fluidity improvers such as silica, titania and alumina and cleaning or transfer aids such as fine polystyrene particles and fine poly(vinylidene fluoride) particles. Particularly, silica and titania having a primary-particle diameter of from 5 to 100 nm are preferably used. The external additive is generally added in an amount of from 1 to 3% be weight based on the weight of the toner particles.

The carrier as another component of the electrostatic-image developer of the present invention comprises a core coated with a resin. Examples of the material of the core include magnetic metals such as iron, steel, nickel and cobalt and magnetic oxides such as ferrite and magnetite. Of these, ferrite is especially preferably used. Examples of the coating resin of the carrier which can be used herein include fluorine-containing acrylic polymers, polyurea resins, styrene-acrylic resins, polyolefin resins, polyamide resins, silicone resins and polyurethane resins. The resin is generally coated in an amount of from 0.1 to 5.0% by weight, preferably from 0.1 to 3.0% by weight based on the weight of the core.

The resin-coated carrier in the present invention should have an average particle diameter of from 30 to 60 $\mu$m. The average particle diameter of the resin-coated carrier is preferably from 35 to 50 $\mu$m, more preferably from 35 to 45 $\mu$m. If the average particle diameter of the carrier is smaller than 30 $\mu$m, carrier flying (BCO: beads carry-over) occurs due to low magnetic force even in a developing machine equipped with a magnetic roll having a high magnetic force. As a result, carrier beads adhere to the resulting copy to generate image defects. On the-other hand, if the average particle diameter thereof is larger than 60 $\mu$m, the toner is apt to be reduced in frictional electrification, to thereby tend to provide images having reduced graininess. The carrier also should have a volume resistivity of from $10^7$ to $10^{11}$ $\Omega$·cm in an electric field of $10^{3.8}$ V/cm. The volume resistivity is preferably from $10^7$ to $10^{10}$ $\Omega$·cm. If the volume resistivity of the carrier is lower than $10^7$ $\Omega$·cm, carrier flying occurs due to its low resistivity even when used in combination with any toner, resulting in carrier bead adhesion to copies to cause image defects. If the volume resistivity thereof exceeds $10^{11}$ $\Omega$·cm, the developer has a reduced developing ability to provide halftone images having impaired graininess. This is presumed to be attributable to the reduction or unevenness of microscopic developing ability on the carrier surface. The proportion of the toner to the carrier is generally from 4:100 to 10:100 by weight.

The yellow, magenta, and cyan toners used besides the black toner in the process for forming a full-color image according to the present invention are then explained. Examples of the resin used as a component of these toners include the same resins as those described above with regard to the black toner. Colorants for use in these toners are not particularly limited, and examples thereof include aniline blue, calco oil blue, chrome yellow, ultramarine blue, Dupont Oil Red, quinoline yellow, methylene blue chloride, copper phthalocyanine, malachite green oxalate, lamp black, Rose Bengal, C.I. Pigment Red 48:1, C.I. Pigment Red 122, C.I. Pigment Red 57:1, C.I. Pigment Red 81, C.I. Pigment Yellow 97, C.I. Pigment Yellow 12, C.I. Pigment Yellow 17, C.I. Pigment Yellow 180, C.I. Pigment Yellow 185, C.I. Pigment Blue 15:1, and C.I. Pigment Blue 15:3. Besides the ingredients described above, the toners may further contain a charge control agent, a cleaning aid and a fluidity improver as needed.

The image forming process of the present invention are then explained. In the present invention, an electrostatic latent image is formed on a latent-image holder by a known method, and the latent image is developed by means of a developer retainer which faces the latent-image holder and on which a developer has been retained by an appropriate means. With regard to the process conditions, the latent-image holder is preferably charged at a potential of from −600 to −750 V, while the image area is preferably charged at a potential of from −150 to −350 V. It is preferred to use a development bias comprising a DC component having a voltage of from −450 to −600 V and an AC component having a frequency of from 3 to 10 kHz and a peak-to-peak voltage ($V_{p-p}$) of from 1,000 to 2,000 V.

The latent-image holder may be any known latent-image holder, such as, e.g., an electrophotographic photoreceptor or a dielectric recording material. The developer retainer is, for example, a developing roll having a development sleeve. For forming a toner layer on the latent-image holder, a known means employing a layer-regulating member or the like is used. In the case of forming a full-color image, developers respectively containing the yellow, magenta, and cyan toners described above are used with the developer containing the black toner. In this case, the image-forming process can comprised successively forming yellow, magenta, cyan and black images on an electrostatic holder or intermediate transfer member to form a superimposed full-color image, and transferring the superimposed full-color image to a receiving material concurrently.

With regard to the development in the present invention, the black toner is preferably used in such a manner that the maximum color density in solid areas on the receiving paper is from 1.5 to 1.9 and further the toner amount per unit area, TMA (mg/cm$^2$), thereof is in the following range.

$$0.60 \leqq \text{TMA} \leqq 1.20$$

The present invention will be described in more detail below by reference to the following Examples, but the invention should not be construed as being limited thereto. All parts and percents are by weight, unless otherwise indicated.

Particle diameter and particle diameter distribution were determined with Coulter Counter Type TA2.

For measuring the image density, a micro-scanning densitometer having a solid size of 20 $\mu$m by 500 $\mu$m was used. Gloss was measured with a glossmeter (at an angle of 75 degrees).

The softening point of toner particles was determined as follows. The toner particles were analyzed with CFT-500C, manufactured by Shimadzu Corp., Japan, under the conditions as shown below. From the results obtained, a graph was made by plotting toner outflow stroke as ordinate and temperature as abscissa. The temperature at which the toner outflow stroke had become a half, i.e., the mean temperature between the melting initiation temperature and the melting termination temperature, was determined from the graph and taken as a softening point. (Heating initiation temperature, 80° C.; heating rate, 3° C./min; preheating, 300 seconds; pressure, 0.980665 MPa; die size, 1 mm (diameter) by 1 mm (h); sample, 1.05 g)

EXAMPLE 1

| | |
|---|---|
| Polyester binder polymer<br>(Terephthalic acid/cyclohexanediol/bisphenol A ethylene oxide adduct (molar ratio, 50/30/20); $M_w$, 23,000; $M_n$, 3,500; $T_g$, 70° C.) | 93% |
| Colorant<br>(Carbon black having an average particle diameter of 45 nm) | 7% |

The above ingredients were kneaded with a twin-screw kneader, and the resulting mixture was pulverized and classified to obtain toner particles having an average particle diameter of 6.5 $\mu$m. The toner particles thus obtained had a softening point of 110° C.

To 100 parts of the toner particles obtained were added 1.5 parts of fine silicon oxide particles having an average particle diameter of 40 nm and surface-treated with hexamethyldisilazane, and 1.6 parts of fine silicon oxide particles having an average particle diameter of 20 nm and surface-treated with trimethoxydecylsilane. This mixture was treated with a Henschel mixer and then screened with a screen having an opening size of 45 μm to obtain a toner.

| (Carrier) | |
|---|---|
| Cu—Zn-ferrite core (average particle diameter, 35 μm) | 100 parts |
| Fluorinated acrylic polymer (perfluorooctylethyl methacrylate/methyl methacrylate copolymer (copolymerization ratio, 1/1)) | 0.5 parts |

The Cu—Zn-ferrite core particles were prepared by a spray formation process. The above ingredients were mixed by means of a kneader and then dried to obtain carrier particles having a volume-average particle diameter of about 35 μm. The carrier particles had a volume resistivity of $10^9$ Ω·cm in an electric field of $10^{3.8}$ V/cm.

(Black Developer)

The toner and carrier described above were mixed in a weight ratio of 10/100 to prepare a black developer.

EXAMPLE 2

A black developer was prepared in the same manner as in Example 1, except that the carbon black content of the black toner particles was changed to 6.0%.

EXAMPLE 3

A black developer was prepared in the same manner as in Example 1, except that the polyester binder polymer used for the black-toner production was replaced with a terephthalic acid/cyclohexanediol/bisphenol A ethylene oxide adduct copolymer (molar ratio, 50/30/20; $M_w$, 11,000; $M_n$, 3,200; $T_g$, 65° C.). The toner particles thus produced had a softening point of 100° C.

EXAMPLE 4

A black developer was prepared in the same manner as in Example 1, except that the volume-average particle diameter of the toner particles was changed to 4.0 μm.

EXAMPLE 5

A black developer was prepared in the same manner as in Example 1, except that the use amount of the fluorinated acrylic polymer was changed to 1.5 parts in the carrier preparation. The carrier thus prepared had a volume resistivity of $10^{11}$ Ω·cm in an electric field of $10^{3.8}$ V/cm.

EXAMPLE 6

A black developer was prepared in the same manner as in Example 1, except that the volume-average particle diameter of the carrier was changed to 50 μm by changing the inner-diameter of the spray nozzle used in the particle formation of the core.

EXAMPLE 7

A black developer was prepared in the same manner as in Example 1, except that the polyester binder polymer used for the black-toner production was replaced with a terephthalic acid/bisphenol A propylene oxide adduct/bisphenol A ethylene oxide adduct/glycerol copolymer (molar ratio, 50/30/15/5; $M_w$, 41,000; $M_n$, 3,600; $T_g$, 69° C.). The toner particles thus produced had a softening point of 120° C.

EXAMPLE 8

A black developer was prepared in the same manner as in Example 1, except that the carrier used therein was replaced with that obtained as follows. Each 10 parts of the fluorinated acrylic polymer used in Example 1 and a carbon black having an average particle diameter of 20 nm were, respectively, mixed with 90 parts of toluene and subjected to dispersing for 30 minutes to prepare pastes thereof. The thus obtained pastes were coated on the Cu—Zn-ferrite core particles used in Example 1 in a fluorinated acrylic polymer coating amount and a carbon black coating amount of 2.6 parts and 0.4 parts, respectively, per 100 parts of the core particles. The thus obtained carrier had a volume resistivity of $10^7$ Ω·cm in an electric field of $10^{3.8}$ V/cm.

EXAMPLE 9

A black developer was prepared in the same manner as in Example 1, except that the carbon black content of the black toner particles was changed to 8.0%.

EXAMPLE 10

A black developer was prepared in the same manner as in Example 1, except that the carbon black used for black toner was replaced with one having an average particle diameter of 60 nm.

EXAMPLE 11

A black developer was prepared in the same manner as in Example 1, except that the volume-average particle diameter of the toner particles was changed to 9.0 μm.

EXAMPLE 12

A black developer was prepared in the same manner as in Example 1, except that the polyester binder polymer used for black-toner production was replaced with a terephthalic acid/bisphenol A propylene oxide adduct/bisphenol A ethylene oxide adduct/glycerol copolymer (molar ratio, 50/25/15/10; $M_w$, 220,000; $M_n$, 5,300; $T_g$, 73° C.), and that the average particle diameter of the carbon black, the volume-average particle diameter of the toner particles and the average particle diameter of the carrier were changed to 20 nm, 9.0 μm and 50 μm, respectively. The volume-average particle diameter of the carrier was changed by changing the inner-diameter of the spray nozzle used in the particle formation of the core. The toner particles produced had a softening point of 135° C.

Comparative Example 1

A black developer was prepared in the same manner as in Example 1, except that the volume-average particle diameter of the toner particles was changed to 11.0 μm.

Comparative Example 2

A black developer was prepared in the same manner as in Example 1, except that the carbon black content of black toner was changed to 5.0%.

Comparative Example 3

A black developer was prepared in the same manner as in Example 1, except that the carbon black content of the black toner was changed to 9.0%.

Comparative Example 4

A black developer was prepared in the same manner as in Example 1, except that the volume-average particle diameter of the carrier was changed to 25 μm by changing the inner-diameter of the spray nozzle used in the particle formation of the core.

Comparative Example 5

A black developer was prepared in the same manner as in Example 1, except that the carrier was replaced with one having an average particle diameter of 80 μm.

Comparative Example 6

A black developer was prepared in the same manner as in Example 1, except that the carrier used therein was replaced with that obtained as follows. Each 10 parts of the fluorinated acrylic polymer used in Example 1 and a carbon black having an average particle diameter of 20 nm were, respectively, mixed with 90 parts of toluene and subjected to dispersing for 30 minutes to prepare pastes thereof. The thus obtained pastes were coated on the Cu—Zn-ferrite core particles used in Example 1 in a fluorinated acrylic polymer coating amount and a carbon black coating amount of 1.6 parts and 0.4 parts, respectively, per 100 parts of the core particles. The thus obtained carrier had a volume resistivity of $10^6$ Ω·cm in an electric field of $10^{3.8}$ V/cm.

Comparative Example 7

A black developer was prepared in the same manner as in Example 1, except that the use amount of the fluorinated acrylic polymer was changed to 3.0 parts in the carrier preparation. The carrier thus prepared had a volume resistivity of $10^{12}$ Ω·cm in an electric field of $10^{3.8}$ V/cm.

EXAMPLE 13

(Black Developer)

The same black developer as used in Example 1 was prepared.

(Color Developers)

The same procedure for preparing the black-developer in Example 1 was conducted, except that 7.0% by weight of C.I. Pigment Yellow 180 was used in place of the carbon black used for the black toner. Thus, a yellow developer was prepared. Further, the same procedure for preparing the black-developer in Example 1 was conducted, except that 5.0% by weight of C.I. Pigment Red 57:1 was used in place of the carbon black used for the black toner. Thus, a magenta developer was prepared. Furthermore, the same procedure for preparing the black-developer in Example 1 was conducted, except that 5.0% by weight of C.I. Pigment Blue 15:3 was used in place of the carbon black used for the black toner. Thus, a cyan developer was prepared. Solid areas of these three colors each had a gloss of 45.

(Image Formation)

The above described developers were introduced into a copier (obtained by modifying A-Color 635, manufactured by Fuji Xerox Co., Ltd.). A chart having black, yellow, magenta and cyan thin lines varying in width from 100 to 500 μm and further having solid images of these colors was used to form yellow, cyan, magenta and black images, which were then superimposed to form a full-color image. The paper used for forming images thereon had a surface smoothness of 100 sec. The amount of the thus-deposited toner per unit area was 1.0 mg/cm$^2$ as measured in an area having the maximum color density. Separately, a development was conducted using the black developer alone to form only a black toner image. The results obtained are shown in Table 1 below.

The test conditions used were as follows: DRS (a distance between a photosensitive layer and a developing roll), 0.5 mm; potential of nonimage area ($V_h$), 650 V; potential of image area ($V_1$), 200 V; development bias ($V_{dc}$), 500 V; $V_{p—p}$, 1.5 kV; frequency, 6 kHz; M/R (magnetic roll) magnetic flux density, 1,000 G.

EXAMPLE 14

Each of the black developers obtained in Examples 2 to 11 and comparative Examples 1 to 7 was introduced into a copier for evaluation (A-Color 635, manufactured by Fuji Xerox Co., Ltd.) together with the color developers described in Example 13. Full-color copy images and black copy images were formed under the same conditions as in Example 13. Furthermore, the black developer obtained in Example 12 was introduced into another copier for evaluation (Brain Tech 8180α, manufactured by Fuji Xerox Co., Ltd.) to form a black copy image. The results obtained are shown in Tables 1 and 2.

Copiers for evaluation:

A: A-Color 635

B: Brain Tech 8180α

Line density of 100-μm line:

○: 0.8 or higher x: lower than 0.8

Gloss in solid area:

not lower than 35 (full-color copier)

not higher than 10 (monochromatic black copier)

TABLE 1

| | Volume-average particle diameter of toner particles (μm) | Average particle diameter of carbon black (nm) | Content of carbon black (%) | Softening point of toner particles (°C.) | Average particle diameter of carrier (μm) | Volume resistivity of carrier at $10^{3.8}$ V/cm (Ω.cm) | Image Quality | | | | | | | |
|---|---|---|---|---|---|---|---|---|---|---|---|---|---|---|
| | | | | | | | Blurring | Graininess in halftone area | Line density of 100-μm line | Carrier flying | Tone of halftone area | Gloss in solid area | Copier for evaluation | Comprehensive evaluation |
| Ex. 1 | 6.5 | 45 | 7.0 | 110 | 35 | $10^9$ | ○ | ○ | 0.90 | ○ | bluish | 45 | A | ○ |
| Ex. 2 | 6.5 | 45 | 6.0 | 110 | 35 | $10^9$ | ○ | ○ | 0.85 | ○ | bluish | 45 | A | ○ |
| Ex. 3 | 6.5 | 45 | 7.0 | 100 | 35 | $10^9$ | ○ | ○ | 0.85 | ○ | bluish | 50 | A | ○ |
| Ex. 4 | 4.0 | 45 | 7.0 | 110 | 35 | $10^9$ | ○ | ○ | 1.0 | ○ | bluish | 45 | A | ○ |
| Ex. 5 | 6.5 | 45 | 7.0 | 110 | 35 | $10^{11}$ | ○ | ○ | 0.80 | ○ | bluish | 45 | A | ○ |

TABLE 1-continued

| | Volume-average particle diameter of toner particles (μm) | Average particle diameter of carbon black (nm) | Content of carbon black (%) | Softening point of toner particles (°C.) | Average particle diameter of carrier (μm) | Volume resistivity of carrier at $10^{3.8}$ V/cm (Ω.cm) | Image Quality: Blurring | Graininess in halftone area | Line density of 100-μm line | Carrier flying | Tone of halftone area | Gloss in solid area | Copier for evaluation | Comprehensive evaluation |
|---|---|---|---|---|---|---|---|---|---|---|---|---|---|---|
| Ex. 6 | 6.5 | 45 | 7.0 | 110 | 50 | $10^9$ | ○ | ○ | 0.85 | ○ | bluiah | 45 | A | ○ |
| Ex. 7 | 6.5 | 45 | 7.0 | 120 | 35 | $10^9$ | ○ | ○ | 0.95 | ○ | bluish | 35 | A | ○ |
| Ex. 8 | 6.5 | 45 | 7.0 | 110 | 35 | $10^7$ | ○ | ○ | 1.0 | ○ | bluish | 45 | A | ○ |
| Ex. 9 | 6.5 | 45 | 8.0 | 110 | 35 | $10^9$ | ○ | ○ | 1.0 | ○ | bluish | 45 | A | ○ |
| Ex. 10 | 6.5 | 60 | 7.0 | 110 | 35 | $10^9$ | ○ | ○ | 0.85 | ○ | bluish | 45 | A | ○ |
| Ex. 11 | 9.0 | 45 | 7.0 | 110 | 35 | $10^9$ | ○ | ○ | 0.80 | ○ | bluish | 45 | A | ○ |
| Ex. 12 | 9.0 | 20 | 7.0 | 135 | 50 | $10^9$ | ○ | ○ | 1.0 | ○ | reddish | 10 | B | ○ |

TABLE 2

| | Volume-average particle diameter of toner particles (μm) | Average particle diameter of carbon black (nm) | Content of carbon black (%) | Softening point of toner particles (°C.) | Average particle diameter of carrier (μm) | Volume resistivity of carrier at $10^{3.8}$ V/cm (Ω.cm) | Image Quality: Blurring | Graininess in halftone area | Line density of 100-μm line | Carrier flying | Tone of halftone area | Gloss in solid area | Copier for evaluation | Comprehensive evaluation |
|---|---|---|---|---|---|---|---|---|---|---|---|---|---|---|
| Comp. Ex. 1 | 11.0 | 45 | 7.0 | 110 | 35 | $10^9$ | ○ | x | 0.75 | ○ | bluish | 45 | A | x |
| Comp. Ex. 2 | 6.5 | 45 | 5.0 | 110 | 35 | $10^9$ | ○ | ○ | 0.70 | ○ | bluish | 45 | A | x |
| Comp. Ex. 3 | 6.5 | 45 | 9.0 | 110 | 35 | $10^9$ | x | ○ | 1.0 | ○ | bluish | 45 | A | x |
| Comp. Ex. 4 | 6.5 | 45 | 7.0 | 110 | 25 | $10^9$ | ○ | ○ | 0.9 | x | bluish | 45 | A | x |
| Comp. Ex. 5 | 6.5 | 45 | 7.0 | 110 | 80 | $10^9$ | x | x | 0.80 | ○ | bluish | 45 | A | x |
| Comp. Ex. 6 | 6.5 | 45 | 7.0 | 110 | 35 | $10^6$ | x | ○ | 1.0 | x | bluish | 45 | A | x |
| Comp. Ex. 7 | 6.5 | 45 | 7.0 | 110 | 35 | $10^{12}$ | ○ | x | 0.7 | ○ | bluish | 45 | A | x |

EXAMPLE 15

Using copier A-Color 635, the black developer obtained in Example 2 was evaluated for image quality under the following two kinds of test conditions regarding copier parameters. As a result, there observed no changes in their image qualities.

TABLE 3

| | Conditions 1 | Conditions 2 |
|---|---|---|
| DRS (mm) | 0.5 | 0.4 |
| $V_h$ (V) (nonimage area) | −650 | −700 |
| $V_l$ (V) (latent image area) | −200 | −300 |
| $V_{dc}$ (V) (development bias) | −500 | −560 |
| $P_{p-p}$ (kV) | 1.5 | 1.0 |
| Frequency (kHz) | 6 | 9 |
| M/R flux density (G) | 1000 | 1200 |

The electrostatic-image developer of the present invention, which contains a small-diameter black toner and has the constitution described above, has a high developing ability and is capable of forming high-quality images free from defects. Therefore, the image forming process using the electrostatic-image developer of the present invention has an excellent effect that images having a sufficient image density can be reproduced with respect to solid images, line images having a width of from 150 to 500 μm and digital dot images, and also that images of thin lines and small characters (6 to 8 points) having a line width of 100 μm and images of digital dots can be reproduced without fail while attaining a sufficient image density. In addition, the images formed are free from blurring and have excellent quality. Furthermore, full-color images of satisfactory quality can be obtained by the image forming process for full-color of the present invention.

While the invention has been described in detail and with reference to specific examples thereof, it will be apparent to one skilled in the art that various changes and modifications can be made therein without departing from the spirit and scope thereof.

What is claimed is:

1. An electrostatic-image developer which comprises:

(i) a toner comprising:

(a) toner particles containing carbon black in an amount of from 6 to 8% by weight based on the weight of the toner particles and having a volume-average particle diameter of from 3 to 9 $\mu$m; and (b) an external additive; and (ii) a resin-coated carrier having a volume resistivity of from $10^7$ to $10^{11}$ Ω·cm in an electric field of $10^{3.8}$ V/cm and an average particle diameter of from 30 to 60 $\mu$m.

2. The electrostatic-image developer as claimed in claim 1, wherein the carbon black has an average particle diameter of from 40 to 60 nm.

3. The electrostatic-image developer as claimed in claim 1, wherein the toner particles have a softening point of from 100° to 120° C.

4. The electrostatic-image developer as claimed in claim 1, wherein a binder resin of the toner particles comprises a polyester.

5. A process for forming a black image which comprises developing an electrostatic latent image on a latent-image holder with a developer layer formed on a developer retainer disposed so as to face the latent-image holder, wherein the developer is an electrostatic-image developer which comprises:

(i) a toner comprising:

(a) toner particles containing carbon black in an amount of from 6 to 8% by weight based on the weight of the toner particles and having a volume-average particle diameter of from 3 to 9 $\mu$m; and (b) an external additive; and (ii) a resin-coated carrier having a volume resistivity of from $10^7$ to $10^{11}$ Ω·cm in an electric field of $10^{3.8}$ V/cm and an average particle diameter of from 30 to 60 $\mu$m.

6. The process for forming a black image as claimed in claim 5, wherein the development is conducted using an AC bias as a development bias.

7. A process for forming a full-color image which comprises:

developing an electrostatic image on a latent-image holder with a developer layer formed on a developer retainer disposed so as to face the latent-image holder, to form a yellow image, a magenta image, a cyan image and a black image; and superimposing these developed images one another to form a full-color image, wherein the black image is formed by using an electrostatic-image developer which comprises:

(i) a toner comprising:

(a) toner particles containing carbon black in an amount of from 6 to 8% by weight based on the weight of the toner particles and having a volume-average particle diameter of from 3 to 9 $\mu$m; and (b) an external additive; and (ii) a resin-coated carrier having a volume resistivity of from $10^7$ to $10^{11}$ Ω·cm in an electric field of $10^{3.8}$ V/cm and an average particle diameter of from 30 to 60 $\mu$m.

8. The process for forming a full-color image as claimed in claim 7, wherein the development is conducted using an AC bias as a development bias.

* * * * *